United States Patent [19]

Oda et al.

[11] Patent Number: 4,867,699

[45] Date of Patent: Sep. 19, 1989

[54] CONNECTOR WITH CHECKING DEVICE

[75] Inventors: Kenzo Oda, Hadano; Kazuhisa Betsui, Tokyo, both of Japan

[73] Assignee: AMP Incorporated, Harrisburg, Pa.

[21] Appl. No.: 316,737

[22] Filed: Feb. 28, 1989

[30] Foreign Application Priority Data

Apr. 6, 1988 [JP] Japan ..... 63-84961

[51] Int. Cl.[4] ..... H01R 13/64

[52] U.S. Cl. ..... 439/355; 439/350; 439/489; 439/680; 439/924

[58] Field of Search ..... 439/135, 146, 353, 355, 439/488, 489, 680, 681, 717, 352, 354, 924, 350, 357, 358

[56] References Cited

U.S. PATENT DOCUMENTS 3,970,354 1/1976 Hopkins et al. .
4,006,959 2/1977 Hopkins et al. .
4,010,996 3/1977 Hopkins et al. .
4,050,764 9/1977 Hopkins et al. .

OTHER PUBLICATIONS

Spec. & Dwgs. from Japanese Appln. No. 62/307332, Filed on 12-4-87.

*Primary Examiner*—Steven C. Bishop
*Attorney, Agent, or Firm*—Adrian J. LaRue; Bruce J. Wolstoncroft

[57] ABSTRACT

An electrical connector comprises first and second connectors that must be completely mated and latched together before a fourth connector can be completely mated with a third connector. A checking means is located on the first connector and the fourth connector which prevents the fourth connector from being mated with the third connector when the second connector is missing from the first connector.

11 Claims, 8 Drawing Sheets

CONNECTOR WITH CHECKING DEVICE

FIELD OF THE INVENTION

This invention relates to an electrical connector with a checking means and more particularly to an electrical connector that is structured so that it is possible to detect whether the connectors are properly mated or securely latched, i.e. whether the connectors are properly or improperly fitted together. This takes place when an attempt is made to fit a second connector of a sensing circuit onto a first connector of the sensing circuit when a second connector of a control circuit does not fit securely onto a first connector of the control circuit.

The first and second connectors of the control circuit are equipped with a first latching device which guarantees that these connectors are securely latched together and remain in this condition.

The first and second connectors of the sensing circuit are equipped with a second latching device which guarantees that when the second sensing circuit connector has been securely latched to the first sensing circuit connector, they remain latched together.

BACKGROUND OF THE INVENTION

It is known to provide a latching device on a matable pair of electrical connectors which maintains the connectors in a completely-mated position to complete electrical circuits of electrical equipment. Even if the connectors are in a partly-mated and not a completely-mated position, the latching device can leave the connectors in the partly-mated position so that the electrical circuits are still completed; however, the partly-mated connectors can become disconnected as a result of external forces thereby disconnecting the electrical circuits which will discontinue or prevent the operation of the electrical equipment. Connectors are also known with a latching device which also detects the partly-mated position.

Nevertheless, use of the known connectors will not prevent them from being partly-mated so that disconnection of the connectors is always possible thereby stopping or preventing operation of the electrical equipment. Such known connectors have low reliability thereby creating a strong demand for connectors with a checking means to assure that the connectors are completely mated especially for use in the control and sensing circuits of an automobile airbag system.

SUMMARY OF THE INVENTION

The objective of the present invention is to provide an electrical connector with a checking means which prevents the connector from being partly-mated with another connector as well as not permitting a further connector from mating with the connector unless the connectors are completely mated together.

Another object of the present invention is to provide a completely reliable connector.

According to the present invention, an electrical connector comprises first and second matable connectors and third and fourth matable connectors whereby the fourth connector cannot be matable with the third connector unless the first and second connectors are completely mated together because the first and fourth connectors include a checking means to prevent the fourth connector from being mated with the third connector. The fourth connector also cannot mate with the third connector if the second connector is not completely mated with the first connector because the fourth and second connectors include a checking means to prevent the third and fourth connectors from being mated or to cause the first and second connectors and the third and fourth connectors to be completely mated by completely mating the third and fourth connectors. The first and second connectors and the third and fourth connectors also provide an audible indication when they are completely mated.

BRIEF DESCRIPTION OF THE DRAWINGS

The invention will now be described by way of example with reference to the following detailed description of the invention in conjunction with the accompanying drawings.

DETAILED DESCRIPTION OF THE INVENTION

Figure 1:
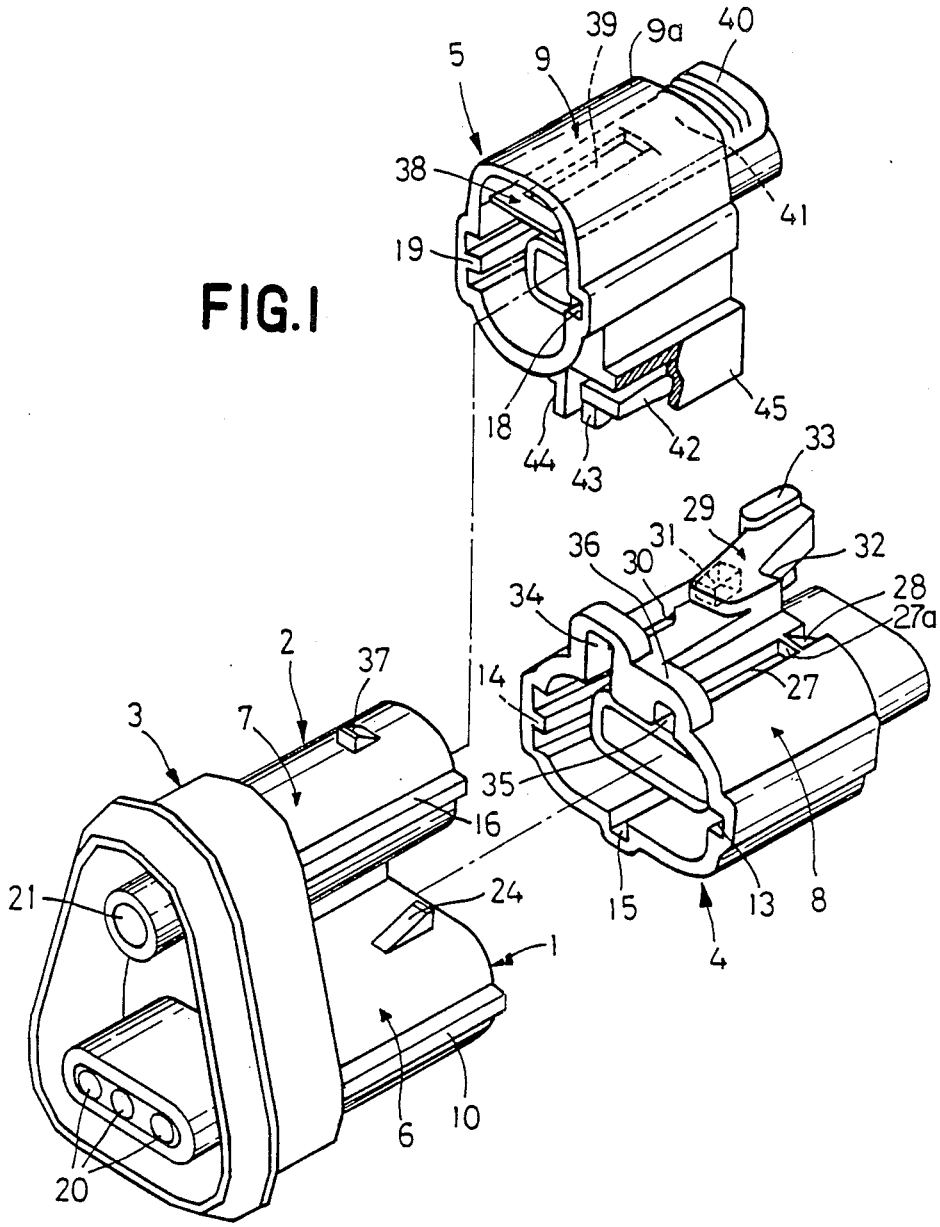
FIG. 1 is an exploded perspective view of the connector housings viewed from a first direction and when properly mated together form the electrical connector of the present invention.
Figure 2:
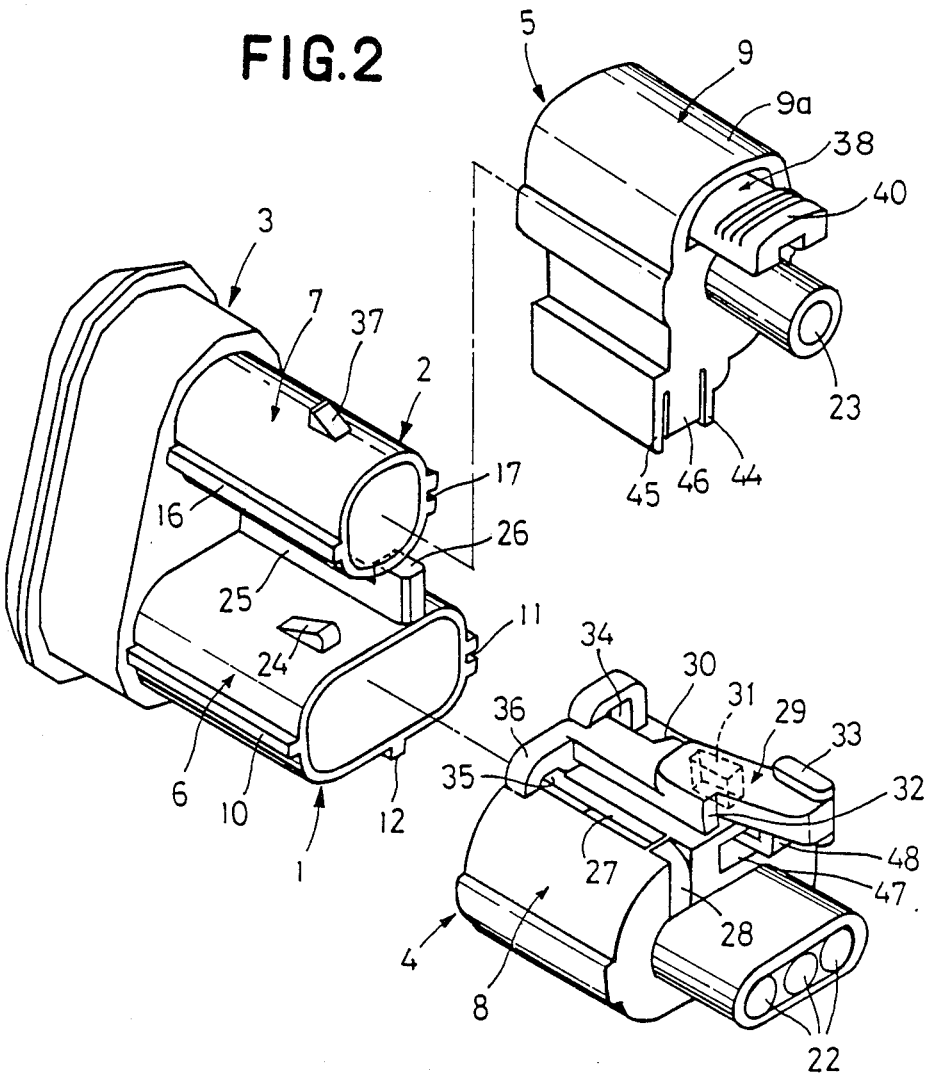
FIG. 2 is the same as FIG. 1 viewed from a second direction.

FIGS. 1 and 2 show the various connector housings that are matable together to form an electrical connector to complete electrical sensing and control circuits for use in conjunction with electrical equipment of the type as for example an airbag system of an automobile. It is extremely important that the airbag system is operational, therefore an electrical control circuit is part of the airbag system to control operation thereof while a sensing circuit senses whether the system is in condition for operation and will so indicate if it is not. An important part of the airbag system is the electrical connector that connects the electrical wires of the control and sensing circuits and assures that the connector members are completely mated and securely latched together.

Only the connector housings are shown without the inclusion of matable electrical contacts terminated to appropriate electrical wires and secured in position in the connector housings to simplify the description of the invention as these are conventional and need not be shown to understand the present invention; however, the connector housings will be referred to as electrical connectors because that is their intended function.

Electrical connectors 1 and 2 are part of a support member 3 interconnecting them so that they are parallelly spaced with respect to each other. Electrical connectors 4 and 5 are separate and are electrically matable with electrical connectors 1 and 2, respectively. Electrical connectors 1 and 4 are part of an electrical control circuit while electrical connectors 2 and 5 are part of an electrical sensing circuit. Connectors 1, 2, 4 and 5 include housings 6, 7, 8 and 9, respectively, and these housings and support member 3 are molded from a suitable dielectric material.

Housing 6 has an exterior projection 10 extending along one side wall, an exterior slot 11 extending along an opposite side wall and a projection 12 extending along the bottom wall. Housing 8 has interior slots 13 and 15 extending respectively along a side wall and bottom wall and an interior projection 14 extending along an opposite side wall. Projections 10, 12, and slot 11 of housing 6 are matable with slots 13, 15 and projection 14 of housing 8 when connectors 1 and 4 are mated together.

Housing 7 has an exterior projection 16 and an exterior slot 17 extending along respective sides which respectively mate with interior slot 18 and exterior projection 19 of housing when connectors 2 and 5 are mated together.

Figure 3:
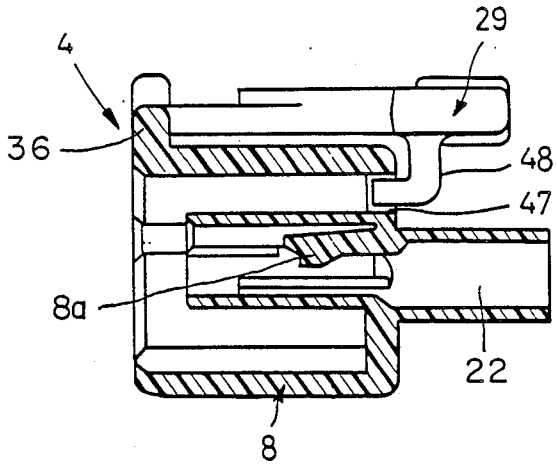
FIG. 3 is a cross-sectional view of one of the control circuit connector housings.

Housings 6, 7, 8 and 9 have contact-receiving passageways 20, 21, 22 and 23, respectively, in which electrical contacts terminated to electrical wires (not shown) are secured preferably by resilient integral housing lances 8a as shown in FIG. 3. Sealing grommets are also secured onto the terminated wires adjacent the contacts for sealing engagement with the passageways.

Housing 6 also includes an exterior wedge-shaped projection 24 on the upper wall adjacent the front end. An exterior projection 25 also extends along the upper wall between projection 24 and the side wall and it includes a latching projection 26 at its front end.

Housing 8 has an exterior slot 27 in an upper wall which extends between guide opening 35 in a front projection 36 and a surface **27*a* in alignment with projection 24 on housing 6. A sloped surface 28 extends beyond surface 27*a* in alignment therewith. A resilient latch member 29 extends rearwardly from front projection 36 along the upper wall and parallel to slot 27 and is movable relative to the upper wall. Cam surface 30 is located on a side surface of latch member 29 in alignment with a guide opening 34 in front projection 36 and in alignment with latching projection 26 of housing 6. A latching recess 31 is located in the side of latch member 29 rearwardly of cam surface 30 and in alignment therewith for latchably receiving latching projection 26 of housing 6. Section 33 at a free end of latch member 29 is for engagement by an operator to operate latch member 29**.

Housing 7 has an exterior wedge-shaped latching projection 37 on an upper surface adjacent a front end. Housing 9 has a stiffly-flexible integral latching member provided with a rectangular latching opening 3 and an outwardly-extending section 40 for engagement by an operator to operate latching member 38 about an area 41 at which latching member 38 is pivotally connected to housing 9. A hood **9*a* covers latching member 38 containing opening 9 to protect it and prevent the latching member 38** from becoming entangled with wires.

Figure 4:
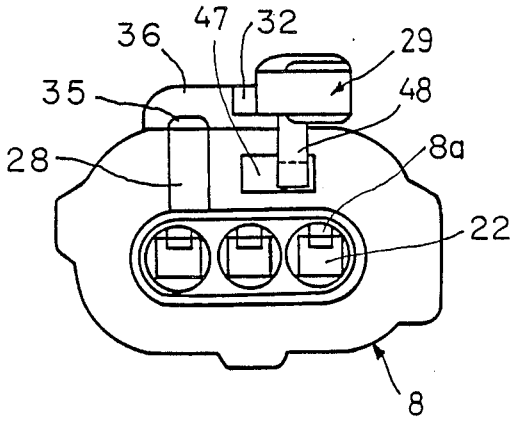
FIG. 4 is a rear elevational view of the connector housing of FIG. 3.

A stiffly-flexible arm 42 extends forwardly from a base member 46 at a bottom of housing 9 between extensions 44 and 45 that extend downwardly from the bottom of housing 9. A projection 43 having a tapered front surface and an arcuate rear surface extends downwardly from a front end of flexible arm 42 as best shown in FIGS. 4–6.

A rectangular opening 47 is located in the upper part of the rear wall of housing 8 to the right of sloped surface 28. An L-shaped arm 48 extends downwardly from latch member 29 adjacent its outer end with the free end of arm 48 being disposed within opening 47. Arm 48 limits the horizontal and vertical movement of latch member 29 thereby protecting it from being damaged by excessive horizontal and vertical movement.

Connectors 1, 2, 4 and 5 operate in accordance with the following description.

Figure 5:
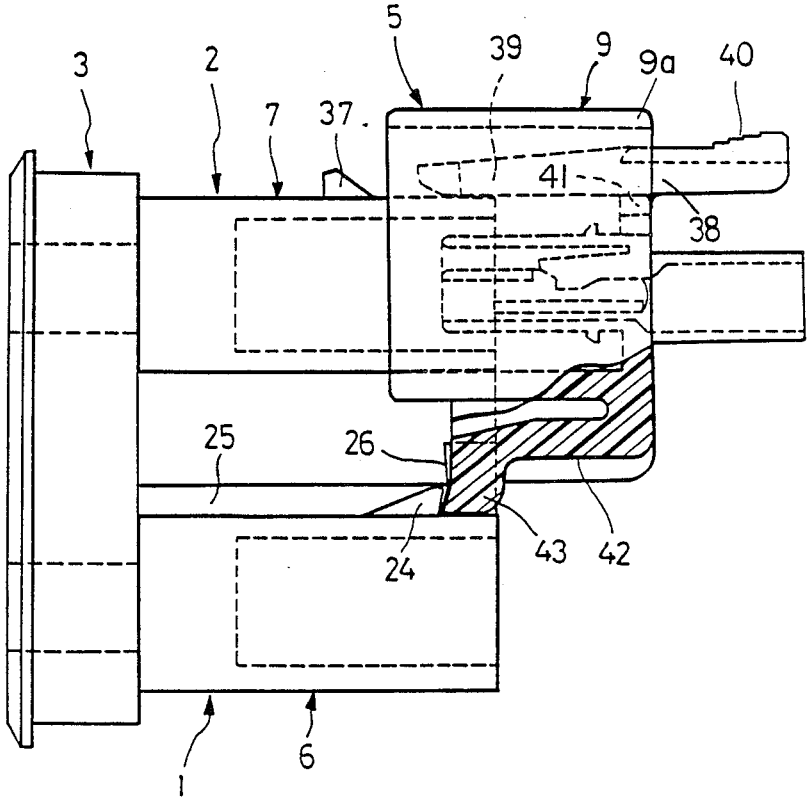
FIG. 5 is a side elevational view of the sensing circuit connector housings partly in cross section showing how these connector housings are prevented from completely mating together when the control circuit connector housings are not mated together.
Figure 6:
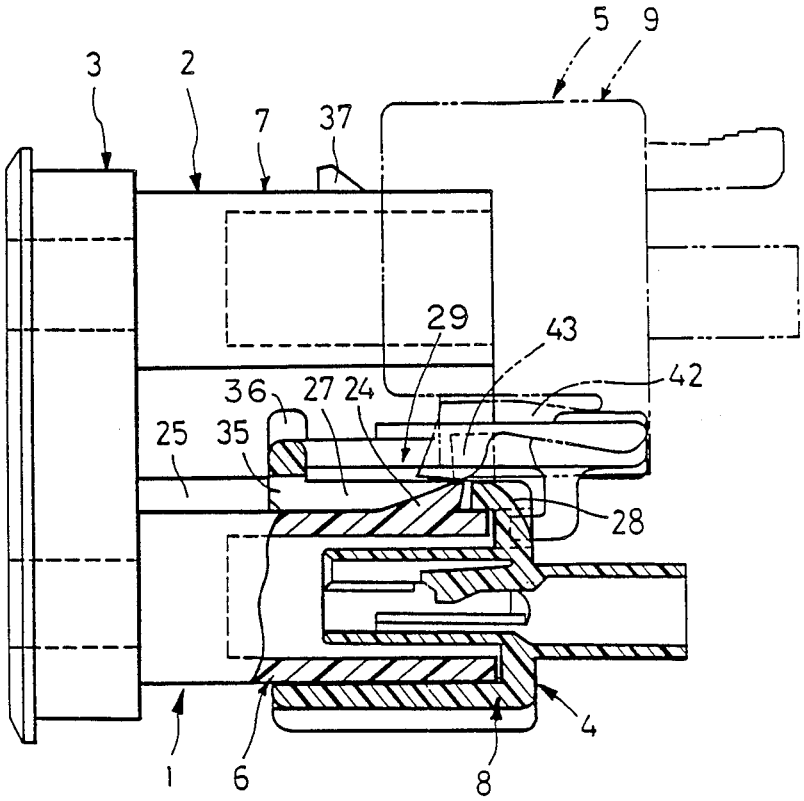
FIG. 6 is a side elevational view showing the control circuit connector housings partly in cross section completely mated together and the sensing circuit connector housings in a partly-mated position prior to being completely mated together.

As FIG. 5 indicates, when an attempt is made to mate connector 5 with connector 2 to complete the sensing circuit when connector 4 of the control circuit is not mated with connector 1, protrusion 43 on housing 9 engages the front tapered surface of projection 24 on housing 6. As a result, connector 5 cannot be mated with connector 2 which means that this arrangement performs a check or an indication that connector 4 must first be completely mated with connector 1 before connector 5 can be completely mated with connector 2.

Figure 10:
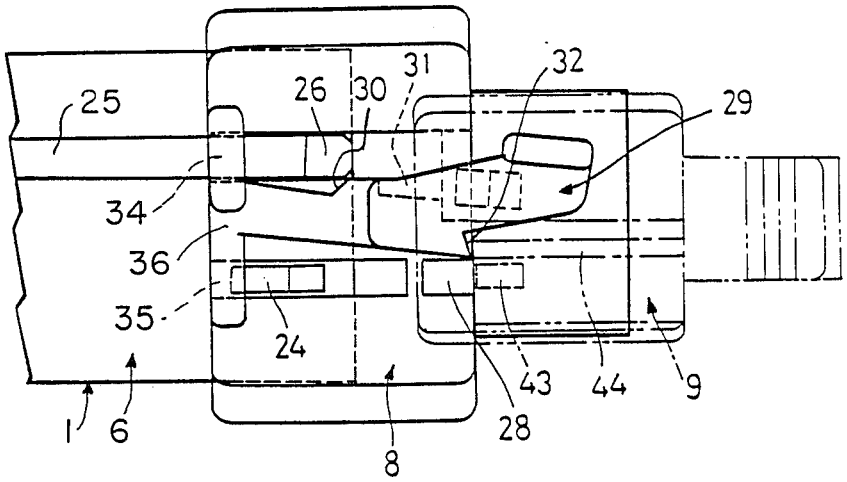
FIG. 10 is a view similar to FIG. 9 showing that the one sensing circuit connector housing cannot be completely mated with the other sensing circuit connector housing because the control circuit connector housings are not completely mated.
Figure 11:
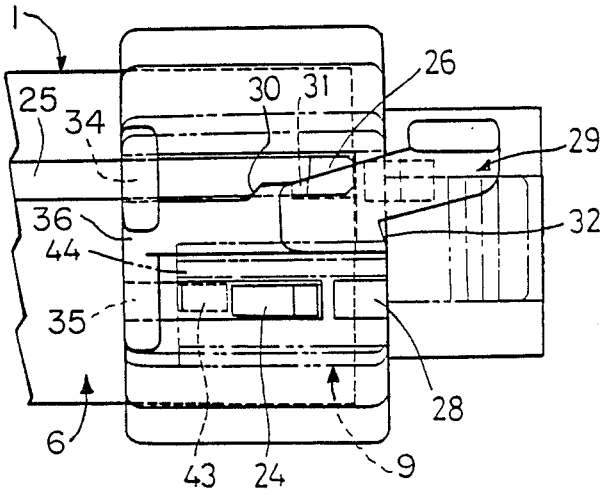
FIG. 11 is a view similar to FIGS. 9 and 10 showing the control circuit connector housings completely mated so that the sensing circuit connector housings can now be completely mated.

When connector 4 is completely mated with connector 1 to complete the control circuit, connector 5 can then be completely mated with connector 2 to complete the sensing circuit. Thus, when connector 4 is mated with connector 1, projection 24 and latching projection 26 of housing 6 pass through respective guide openings 35, 34 of housing 8 and projection 24 moves along slot 27 of housing 8 and engages rear surface **27*a* thereof while cam surface 30 of latching arm 29 engages latching projection 26 causing latching arm 29 to move inwardly, as shown in FIG. 10, and then to move outwardly when cam surface 30 moves beyond latching projection 26 whereby latching projection 26 is disposed within latching recess 31, as shown in FIG. 11, when latching arm 29 returns to its normal position thereby latching connectors 1 and 4** in a completely mated position.

An audible indication occurs when connectors 1 and 4 are completely and latchably mated together as a result of latching arm 29 forcefully engaging latching projection 26 due to the elastic forces generated by moving latching arm 29 from its normal position causing latching arm 29 to return to its normal position.

Figure 7:
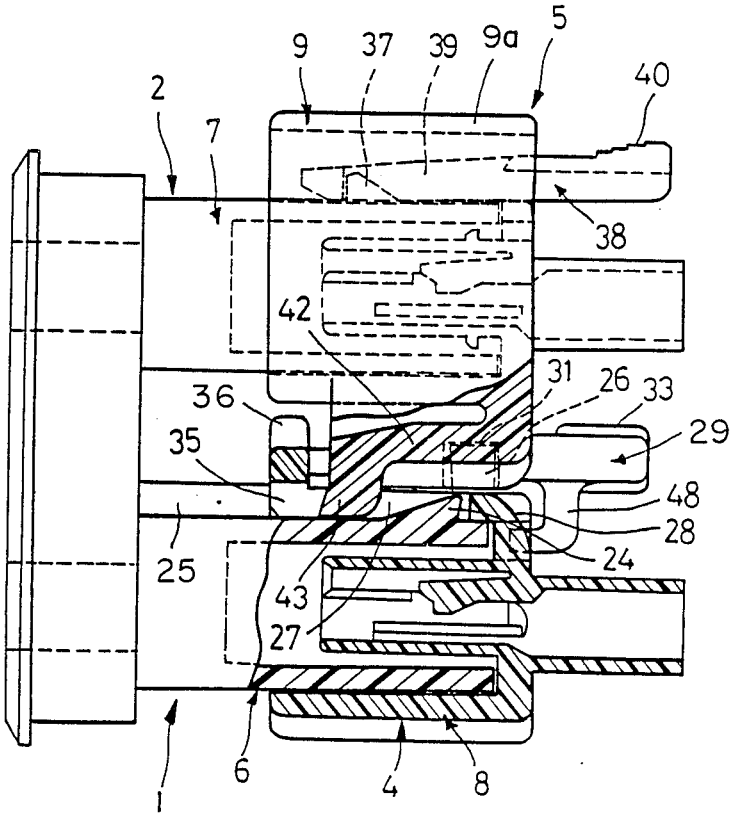
FIG. 7 is a view similar to FIG. 6 showing the control circuit connector housings and the sensing circuit connector housings completely mated together in latched positions.

With connectors 1, 4 completely mated together as shown in FIGS. 6 and 7, connector 5 can now be mated with connector 2. As shown in FIG. 6, projection 43 of housing 9 moves along sloped surface 28 causing arm 42 to move upwardly and then projection 43 moves along the top and tapered rear surface of projection 24 on housing 6 and then along recess 27 while the tapered bottom front surface of latching member 38 of housing 9 is moved upwardly as it moves along the tapered front surface of latching projection 37 on housing 7 and then latching member 38 moves down in engagement with housing 7 with latching projection 37 being located within latching opening 39 with a front surface of opening 39 in engagement with the rear perpendicular surface of latching projection 37, as shown in FIG. 7, thereby latching connectors 2 and 5 together in a completely mated position.

An audible indication also occurs when connector 5 completely and latchably mates with connector 2 because projection 43 forcefully engages front projection 36, and latching member 38 forcefully engages housing 7 as a result of the elastic forces generated by moving latching member 38 upwardly from its normal position.

Figures 8, 9:
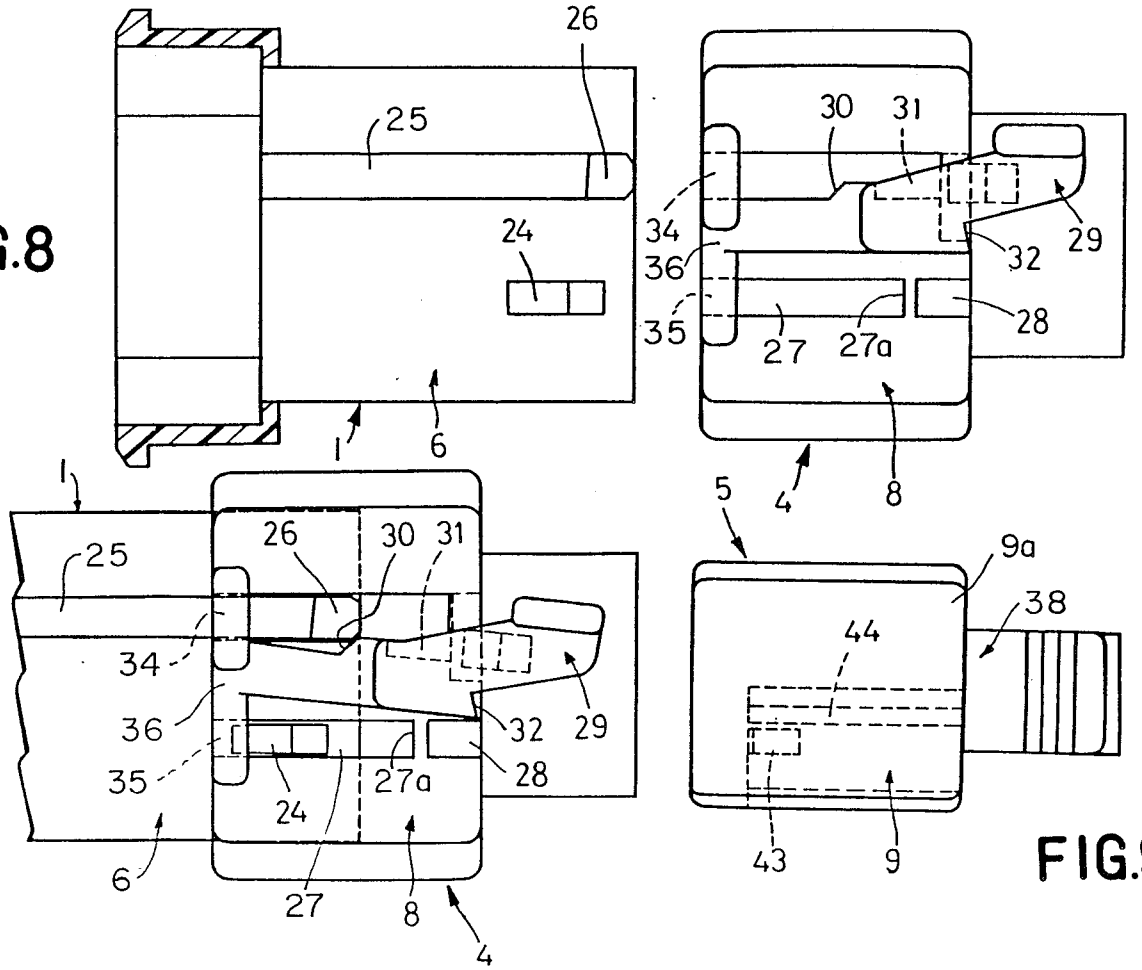
FIG. 8 is a top plan view showing the control circuit connector housings prior to being mated together.
FIG. 9 is a view similar to FIG. 8 showing the control circuit connector housings partly mated together and one of the sensing circuit connector housing spaced therefrom.

If connector 4 is not completely mated with connector 1 because the latching arm 29 of housing 8 is not latched to latching projection 26 of housing 6 by latching projection 26 being positioned within latching recess 31 of latching arm 29 as shown in FIGS. 9 and 10, then connector 5 cannot be mated with connector 2. The reason for this is that latching arm 29 has not returned to its normal position thereby positioning surface 32 of latching arm 29 for engagement by extension 44 of housing 9 thereby preventing connector 5 from mating with connector 2. This arrangement performs another check or indication that connectors 1 and 4 are not completely mated.

On the other hand, if connectors 1 and 4 are not completely mated because connector 5 cannot be mated with connector 2, connectors 1 and 4 can then be completely mated by moving them to their completely-mated position or moving connector 5 to its completely-mated position on connector 2 will also move connector 4 to its completely-mated position on connector 1 because extension 44 by engaging surface 32 of latching arm 29 will move connector 4 forwardly causing cam surface 30 of latching arm 29 to move free of latching projection 26 and enable latching arm 29 to move outwardly so that latching projection 26 is received in latching recess 31 thereby resulting in connectors 1, 4 and 2, 5 being completely mated and latched together.

After connectors 1, 4 and 2, 5 have been completely mated and latched together, to disconnect them, connector 5 must first be disconnected from connector 2 before connector 4 can be disconnected from connector 1. Thus, this prevents connector 4 from being disconnected from connector 1 unless connector 5 has been disconnected from connector 2.

If connector 4 is attempted to be disconnected from connector 1 while connector 5 is connected with connector 2, latching arm 29 cannot be moved inwardly because extension 44 of housing 9 prevents such movement thereby preventing connector 4 from being disconnected from connector 1 while connector 5 is connected with connector 2.

Both conditions of when connectors 2 and 5 are either not mated or not completely mated together can also be electrically indicated as part of the sensing circuit.

One feature of the present invention is that the sensing circuit connectors cannot be connected together unless the control circuit connectors are completely mated together.

Another feature is that if the control circuit connectors are partly mated together, the sensing circuit connectors cannot be connected together. Alternatively, the partly-mated control circuit connectors can be completely mated together by completely mating the sensing circuit connectors.

A further feature is that the control circuit connectors cannot be disconnected so long as the sensing circuit connectors are connected together.

An additional feature is an audible indication of the complete mating of the control circuit connectors and the sensing circuit connectors.

We claim:

1. An electrical connector, comprising:

first and second matable connectors having latch members for latching the first and second connectors at a completely-mated position;

third and fourth connectors having latching members for latching the third and fourth connectors at a completely-mated position;

a supporting member supporting the first and third connectors in position for matable engagement with the respective second and fourth connectors;

checking means on the first connector and on the fourth connector to prevent the third and fourth connectors from being mated and latched together without the first and second connectors being completely mated together; and means on said first, second and fourth connectors permitting said fourth connector to be completely matable with said third connector when said first and second connectors are completely mated.

2. An electrical connector as claimed in claim 1, wherein said checking means includes a first projection on said first connector and a second projection on said fourth connector that engage one another when said fourth connector is attempted to be mated with said third connector thereby preventing the fourth connector from mating with said third connector when said second connector is missing from said first connector.

3. An electrical connector as claimed in claim 1, wherein said permitting means comprises a wedge-shaped projection on said first connector that is positioned within a slot adjacent a wall when said first and second connectors are completely mated together, a sloped surface on said first connector in alignment with said wedge-shaped projection and said slot, a movable arm having a projection member located on said fourth connector, said projection member being movable along said sloped surface and said wedge-shaped projection into said slot when said fourth connector is mated with said third connector.

4. An electrical connector as claimed in claim 1, wherein the latch members of said first and second connectors comprise a latching projection on said first connector and an integral latching member on said second connector and having a cam surface that engages said latching projection when the first and second connectors are being mated causing the latching member to be moved away from its normal position, and, when the cam surface moves clear of said latching projection, said latching member moves forcefully back to its normal position so that said latching projection is received within a latching recess of said latching member thereby latching the first and second connectors at a completely-mated position.

5. An electrical connector as claimed in claim 4, wherein the forceful movement of said latching member back to its normal position causes it to engage said latching projection thereby generating an audible indication.

6. an electrical connector as claimed in claim 1, wherein the latch members of the third and fourth connectors comprise a wedge-shaped latching projection on said third connector and an integral latching member pivotally mounted on said fourth connector and having a latching opening in which said latching projection is disposed when said third and fourth connectors are completely mated together.

7. An electrical connector as claimed in claim 6, wherein said latching member is moved away from its normal position by said wedge-shaped latching projection when the third and fourth connectors are being mated and said latching member forcefully returns to its normal position when the latching projection is disposed in said latching opening causing said latching member to engage said third connector thereby generating an audible indication.

8. An electrical connector according to claim 6, wherein a hood member is located or said fourth connector covering said latching member to protect it.

9. An electrical connector as claimed in claim 1, wherein additional checking means are located on said second and fourth connectors to prevent said third and fourth connectors from being mated together when the first and second connectors are not completely mated together.

10. An electrical connector as claimed in claim 9, wherein the additional checking means includes a surface on said latch member of said second connector that is engaged by an extension on said fourth connector.

11. An electrical connector as claimed in claim 1, wherein an extension on said fourth connector prevents said latch member on said second connector from being operated to disconnect the first and second connectors when the third and fourth connectors are completely mated.

* * * * *